US009096923B2

(12) United States Patent
Clinton et al.

(10) Patent No.: US 9,096,923 B2
(45) Date of Patent: Aug. 4, 2015

(54) COATING APPARATUS AND METHOD FOR FORMING A COATING LAYER ON MONOLITH SUBSTRATES

(75) Inventors: Joel Edward Clinton, Waverly, NY (US); Curtis Robert Fekety, Corning, NY (US); Yunfeng Gu, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 393 days.

(21) Appl. No.: 13/293,726

(22) Filed: Nov. 10, 2011

(65) Prior Publication Data

US 2013/0122196 A1 May 16, 2013

(51) Int. Cl.

| | |
|---|---|
| ***B05C 7/04*** | (2006.01) |
| ***B05C 5/00*** | (2006.01) |
| ***B05D 5/00*** | (2006.01) |
| ***B05D 1/00*** | (2006.01) |
| ***C23C 18/12*** | (2006.01) |
| ***B05D 7/22*** | (2006.01) |
| ***C23C 18/02*** | (2006.01) |
| *B05D 3/04* | (2006.01) |

(52) U.S. Cl.

CPC ..... *C23C 18/1262* (2013.01); *B05C 7/04* (2013.01); *B05D 7/22* (2013.01); *C23C 18/02* (2013.01); *C23C 18/125* (2013.01); *B05D 3/0493* (2013.01)

(58) Field of Classification Search

None

See application file for complete search history.

(56) References Cited

U.S. PATENT DOCUMENTS

| | | | | |
|---|---|---|---|---|
| 4,983,423 | A | 1/1991 | Goldsmith | |
| 5,782,959 | A | 7/1998 | Yang et al. | |
| 5,953,832 | A * | 9/1999 | Rosynsky et al. | 34/403 |
| 6,599,570 | B1 * | 7/2003 | Aderhold et al. | 427/238 |
| 7,179,325 | B2 | 2/2007 | Oyama et al. | |
| 8,006,637 | B2 | 8/2011 | Liu et al. | |
| 2004/0001919 | A1 * | 1/2004 | Aderhold et al. | 427/294 |
| 2008/0237919 | A1 * | 10/2008 | Liu et al. | 264/176.1 |
| 2010/0093527 | A1 * | 4/2010 | Hasselmann | 502/334 |

FOREIGN PATENT DOCUMENTS

| | | |
|---|---|---|
| WO | WO99/47260 | 9/1999 |

* cited by examiner

*Primary Examiner* — Dah-Wei D Yuan
*Assistant Examiner* — Jethro M Pence
(74) *Attorney, Agent, or Firm* — Susan S. Wilks

(57) ABSTRACT

A coating apparatus includes modular interfaces and substrate receptors for accommodating various shapes and sizes of monolith substrates when coating layers are applied onto the monolith substrates. The monolith substrates are laterally surrounded by an elastically deformable sleeve that prevents lateral leakage of a vacuum out of the monolith substrate when a vacuum is applied to opposing ends of the monolith substrate, thereby eliminating needs for bulky vacuum chambers. The coating apparatus also includes valves and control apparatus that enable excess precursor liquid to be drained from monolith channels in-situ, without the use of additional spin-drying steps. Coating methods for using the coating apparatus are provided.

7 Claims, 4 Drawing Sheets

COATING APPARATUS AND METHOD FOR FORMING A COATING LAYER ON MONOLITH SUBSTRATES

BACKGROUND

1. Field

The present specification generally relates to coating apparatus and methods and, more particularly to apparatus and methods for coating monolith substrates with coating layers.

2. Technical Background

Porous inorganic membranes have been commercialized for years in industrial liquid filtration separations, and have recently been investigated for gas separation and catalytic reactions. Most recently, they have been explored for gas-particulate separation in diesel particulate filter (DPF) and gasoline particulate filter (GPF) applications, and vapor-vapor separation in on-board separation of gasoline (OBS) applications. For applications such as these, the inorganic membranes may be applied to porous or dense monolith substrates using a variety of coating processes, including dip-coating, slip-casting and spin-coating. Scalability of such processes often depends on amenability of the processes to accommodate various shapes and sizes of monolith substrates. Variances in shapes and sizes among monolith substrates can further complicate apparatus scalability, particularly when the monolith substrates require a centrifugal spin step to remove excess liquid from the channels after being coated.

Accordingly, ongoing needs exist for scalable coating apparatus and methods for coating monolith substrates with coating layers, including but not limited to inorganic membranes.

SUMMARY

According to various embodiments, a coating apparatus for forming a coating layer precursor layer onto a monolith substrate is provided. The coating apparatus may include a liquid-precursor source in fluidic communication with a general inlet interface. The coating apparatus may further include a general outlet interface in fluidic communication with a drawing system. The coating apparatus further may include an elastically deformable sleeve that laterally surrounds the monolith substrate to form a sleeved monolith substrate. The elastically deformable sleeve prevents lateral leakage out of the monolith substrate of a vacuum applied to opposing ends of the monolith substrate not surrounded by the elastically deformable sleeve. An inlet substrate receptor may be positioned between the general inlet interface and the sleeved monolith substrate. An outlet substrate receptor may be positioned between the general outlet interface and the sleeved monolith substrate. When the coating apparatus is operated, the sleeved monolith substrate may be removably interposed between the inlet substrate receptor and the outlet substrate receptor. When the sleeved monolith substrate is positioned in this manner, the inlet substrate receptor accommodates a sleeve inlet end of the sleeved monolith receptor, and the outlet substrate receptor accommodates a sleeve outlet end of the sleeved monolith receptor. Thereby, monolith channels of the monolith substrate are placed in fluidic communication with the general inlet interface and the general outlet interface.

According to further embodiments, methods for forming a coating layer on a monolith substrate are provided, using a coating apparatus that includes a liquid-precursor source in fluidic communication with a general inlet interface; an inlet substrate receptor positioned between the general inlet interface and the sleeved monolith substrate; a general outlet interface in fluidic communication with a drawing system; and an outlet substrate receptor positioned between the general outlet interface and the sleeved monolith substrate. In such embodiments, the methods may include providing a sleeved monolith substrate that includes a monolith substrate laterally surrounded by an elastically deformable sleeve. The elastically deformable sleeve prevents lateral leakage of a vacuum out of the monolith substrate when a vacuum is applied to opposing ends of the monolith substrate not surrounded by the elastically deformable sleeve. The methods may further include positioning the sleeved monolith substrate between the inlet substrate receptor and the outlet substrate receptor so as to establish fluidic communication between the general inlet interface and the general outlet interface through monolith channels of the monolith substrate. Then, a first pressure differential may be established between the liquid-precursor source and the drawing system, so that the first pressure differential draws liquid precursor from the liquid-precursor source and into the monolith channels. The first pressure differential may be maintained at least until the precursor liquid reaches the ends of the monolith channels nearest the outlet substrate receptor. Then, a second pressure differential may be established between the liquid-precursor source and the drawing system, such that the second pressure differential removes excess precursor liquid from the monolith channels.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Reference will now be made in detail to embodiments of a coating apparatus for forming a coating layer on a monolith substrate. The coating apparatus may include a liquid-precursor source in fluidic communication with a general inlet interface. The coating apparatus may further include a general outlet interface in fluidic communication with a drawing system. The coating apparatus further may include an elastically deformable sleeve that laterally surrounds the monolith substrate to form a sleeved monolith substrate. The elastically deformable sleeve prevents lateral leakage out of the monolith substrate of a vacuum applied to opposing ends of the monolith substrate not surrounded by the elastically deformable sleeve. An inlet substrate receptor may be positioned between the general inlet interface and the sleeved monolith substrate. An outlet substrate receptor may be positioned between the general outlet interface and the sleeved monolith substrate. When the coating apparatus is operated, the sleeved monolith substrate may be removably interposed between the inlet substrate receptor and the outlet substrate receptor. When the sleeved monolith substrate is positioned in this manner, the inlet substrate receptor accommodates a sleeve inlet end of the sleeved monolith receptor, and the outlet substrate receptor accommodates a sleeve outlet end of the sleeved monolith receptor. Thereby, monolith channels of the monolith substrate are placed in fluidic communication with the general inlet interface and the general outlet interface. Embodiments of methods for coating monolith substrates using such coating apparatus will be described in greater detail below.

Embodiments of the coating apparatus described herein may contain as a common feature an elastically deformable sleeve that surrounds the monolith substrate being coated using the coating apparatus to form a sleeved monolith substrate. The sleeved monolith substrate will be described now with reference to FIGS. 1 and 2. Thereafter, additional components of the coating apparatus will be described with reference to FIG. 3 to illustrate the interrelation between the sleeved monolith substrate and the coating apparatus as a whole.

Figure 1:
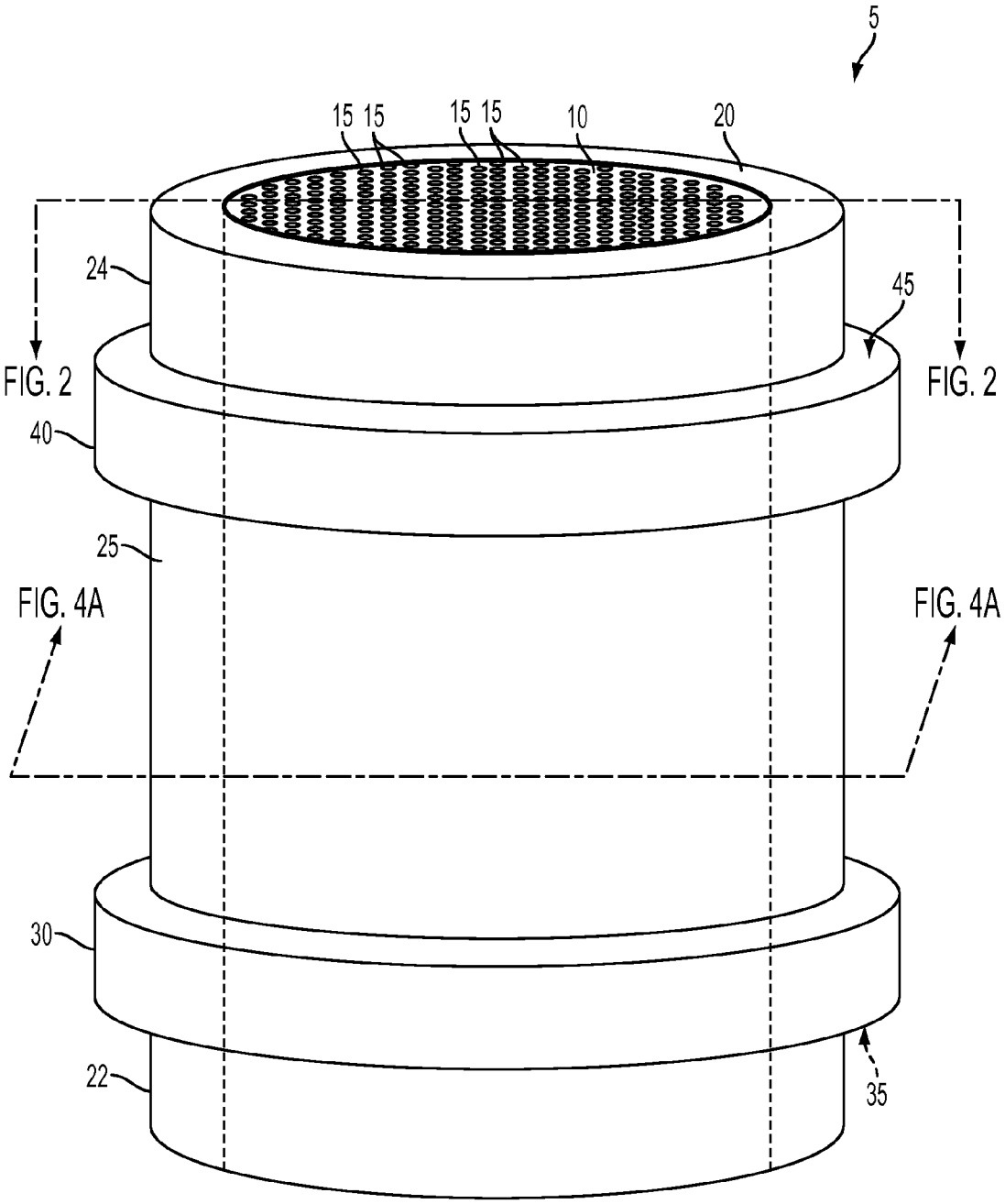
FIG. 1 is a perspective view showing a monolith substrate inside an elastically deformable sleeve according to embodiments described herein.
Figure 2:
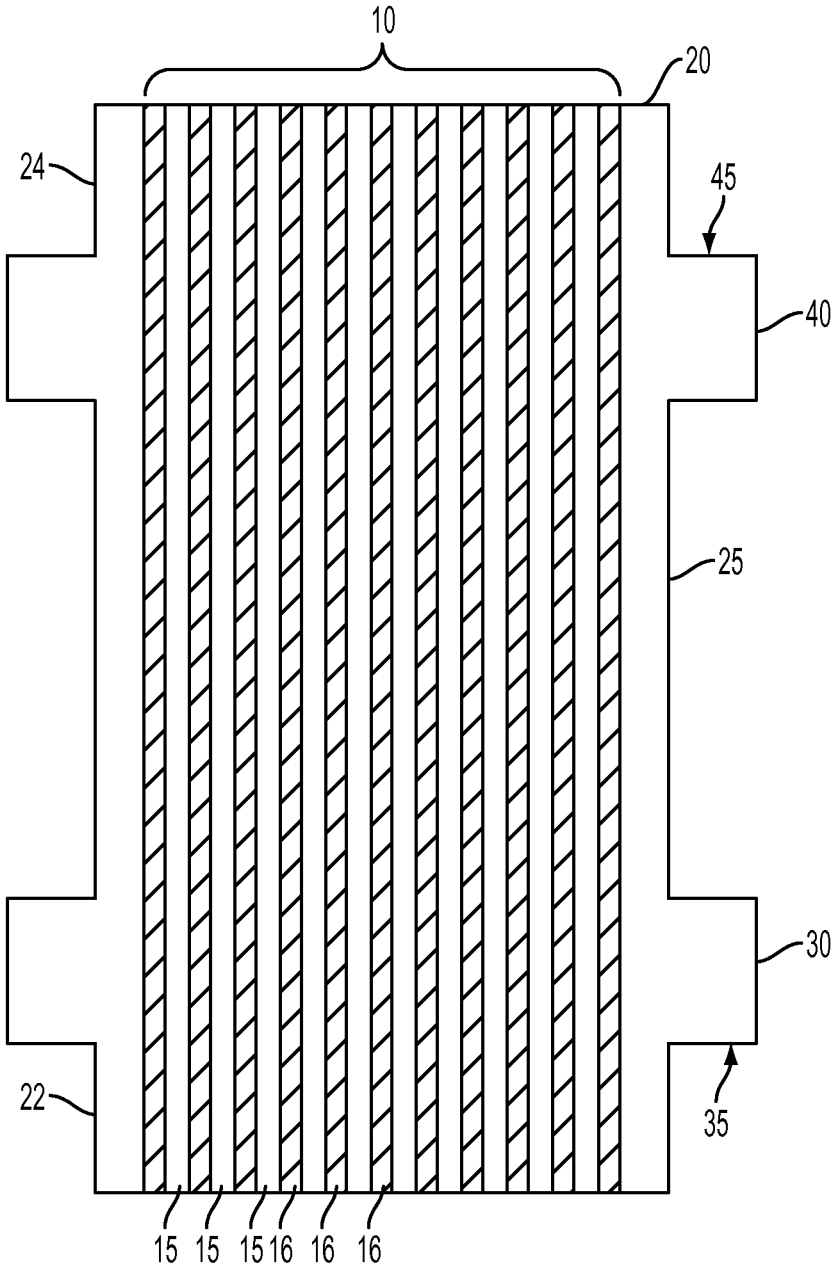
FIG. 2 is a vertical cross-section of the monolith substrate inside the elastically deformable sleeve shown in FIG. 1.

Referring to FIGS. 1 and 2, an embodiment of a sleeved monolith substrate 5 is schematically depicted. The sleeved monolith substrate 5 is composed of a monolith substrate 10 laterally surrounded by an elastically deformable sleeve 20. The elastically deformable sleeve 20 may include a sleeve inlet collar 30 having a sleeve inlet collar surface 35, a sleeve inlet end 22, a sleeve outlet collar 40 having a sleeve outlet collar surface 45, and a sleeve outlet end 24. A sleeve mid-section 25 is defined between the sleeve inlet collar 30 and the sleeve outlet collar 40. The monolith substrate 10 may have monolith channels 15 defined therethrough, such that the monolith channels 15 are open on opposing ends of the monolith substrate 10 not surrounded by or in contact with the elastically deformable sleeve 20. As shown in FIG. 2, the monolith channels 15 may be separated by monolith channel walls 16. The elastically deformable sleeve 20 prevents lateral leakage of a vacuum out of the monolith substrate 10 when the vacuum is applied to the opposing ends of the monolith substrate 10, such as when the monolith channels 15 are in fluidic communication with the applied vacuum. As used herein, the term "lateral" as in "laterally surrounds" refers to sides or faces of the monolith substrate 10 that do not contain openings to the monolith channels 15 inside the monolith substrate 10. As used herein, the term "lateral leakage" refers to leakage through the lateral sides of the monolith substrate 10, typically in a direction perpendicular to the flow paths of the monolith channels 15 inside the monolith substrate 10.

In some embodiments, the monolith substrate 10 may have any shape or size and may be formed from any solid, porous material onto which a coating layer, such as an inorganic membrane precursor layer, can be coated or applied. The monolith substrate 10 may be formed, extruded, or molded, for example. Though the monolith substrate 10 in FIGS. 1 and 2 is shown as cylindrical, it should be understood that this is for illustrative purposes only, not by way of limitation. In further illustrative embodiments, the monolith substrate may have lengths up to 12 inches (30.5 cm) and outer diameters of from 1 inch (2.54 cm) to 3 inches (7.62 cm). Further embodiments of shapes for the monolith substrate 10 include not only cylinders but also, without limitation, shapes with cross sections such as ovals, hexagons, pentagons, rectangles, squares, rhombuses, triangles, or even irregular shapes. In some embodiments, the monolith substrate 10 may be a filter such as, for example, a honeycomb filter.

In some embodiments, the monolith substrate 10 may be formed of materials such as, for example, glass, ceramics in general, oxides (e.g., cordierite, mullite, alumina, yttria, zirconia, zeolite, titania, yttria, tin oxide, and mixtures thereof), non-oxide ceramics (e.g., carbides such as silicon carbide and nitrides such as silicon nitride and carbon nitride), carbon, alloys, metals, polymers, composites of any of these (including fiber-containing composites, for example), and mixtures of any of these. The monolith substrate 10 may contain any number of monolith channels 15, from a single channel to thousands of channels. In some embodiments, the monolith channels 15 may have various cross-sectional shapes, such as circles, ovals, triangles, squares, pentagons, hexagons, or tessellated combinations or any of these, for example, and may be arranged in any suitable geometric configuration. The monolith channels 15 may have various dimensions or diameters that may be the same or different within the monolith substrate 10 itself. The monolith channels 15 may be discrete or intersecting and may extend through the monolith substrate 10 from a first end thereof to a second end thereof, opposite the first end. In exemplary embodiments, the monolith substrate 10 may be a cylindrical or oval cordierite honeycomb monolith having monolith channels 15 that are circular, oval, or hexagonal. The monolith substrate 10 may be porous or non-porous. In illustrative embodiments of porous monolith substrates, the monolith substrate 10 may have surfaces (such as the surfaces of the monolith channel walls 16 defining the monolith channels 15 through the monolith substrate 10) having median pore sizes, for example, of from 1.0 μm to 15 μm or from 1 μm to 10 μm. These surfaces may have porosities, prior to being coated with a coating layer, of from 30% to 60%, for example, as measured by mercury intrusion porosimetry.

In some embodiments, the elastically deformable sleeve 20 is formed from a non-rigid material capable of preventing lateral leakage of a vacuum out of the monolith substrate when the vacuum is applied to opposing ends of the monolith substrate. The elastically deformable sleeve 20 may be formed from a variety of pliable materials that can conform to the outer contours of the monolith substrate 10. The thickness of the elastically deformable sleeve 20 may vary, with the only proviso being that the thickness be sufficient to prevent the lateral leakage of the vacuum out of the monolith substrate 10 in the sleeved monolith substrate 5. In some embodiments, the elastically deformable sleeve 20 is sufficiently non-porous so as to prevent lateral vacuum leakage out of the monolith substrate 10 when a vacuum of from about 2 in. Hg (5.08 cm Hg) to about 30 in. Hg (76.2 cm Hg) is applied to the opposing ends of the monolith substrate 10. Suitable materials for the elastically deformable sleeve 20 meeting the above specifications may include, without limitation, plastics, rubbers such as silicone rubbers and latex, polymers (such as polyethylene, polypropylene, cellophane, Teflon® (polytetrafluoroethylene), for example).

In some embodiments, the elastically deformable sleeve 20 may be customized to fit or accommodate a single particular shape and size of monolith substrate 10 or, alternatively, may have a versatile construction allowing a single elastically deformable sleeve to accommodate a variety of shapes and sizes of monolith substrates. In the non-limiting embodiment shown in FIGS. 1 and 2, the elastically deformable sleeve 20 is a unitary and integral piece. Such a unitary and single piece may be formed by molding, for example, such that the sleeve inlet collar 30 and the sleeve outlet collar 40 are formed as non-removable structural components of the elastically deformable sleeve 20. In such embodiments, the sleeved monolith substrate 5 may be formed by slipping the elastically deformable sleeve 20 around the monolith substrate 10 or by pushing the monolith substrate 10 into the elastically deformable sleeve 20, for example. While the elastically deformable sleeve 20 has been described herein as having a sleeve inlet collar 30 and a sleeve outlet collar 40 which facilitate securing the elastically deformable sleeve to the monolith substrate, it should be understood that these elements are optional and that, in other embodiments, the elastically deformable sleeve 20 may be constructed without the sleeve inlet collar 30 and/or the sleeve outlet collar, such as when the elastically deformable sleeve 20 is sized to fit tightly around the monolith substrate without any additional mechanism for securing the elastically deformable sleeve to the monolith substrate.

In an alternative embodiment, the elastically deformable sleeve 20 may be formed as a double-walled inflatable casing, such that the monolith substrate 10 may be inserted the elastically deformable sleeve 20, and when the casing is inflated it will conform to the contours of a variety of shapes and sizes of monolith substrates to form the sleeved monolith substrate 5.

In further embodiments, the elastically deformable sleeve 20 may comprise multiple pieces. For example, the sleeve inlet collar 30 and the sleeve outlet collar 40 each may be bands of material, such as single or doubled rubber bands, that are positioned appropriately around the sleeve midsection 25 before or after the monolith substrate 10 is positioned inside the elastically deformable sleeve 20.

In further embodiments, the elastically deformable sleeve 20 may be in the form of a wrapping, wherein a sheet of one of the materials listed above is wrapped around the monolith substrate 10 to conform to the outer contours of the monolith substrate 10. In such embodiments, the wrapping may be applied horizontally or diagonally around the monolith substrate 10 until all of the lateral walls of the monolith substrate 10 are covered. Then, the sleeve inlet collar 30 and the sleeve outlet collar 40 may be positioned appropriately on the sleeve midsection 25. In an illustrative embodiment, the elastically deformable sleeve 20 may be a sheet of polytetrafluoroethylene having sufficient thickness to prevent lateral vacuum leakage from the monolith substrate 10. The sheet of polytetrafluoroethylene may be wrapped diagonally to cover the lateral walls of the monolith substrate 10, and then two bands of rubber may be flexed onto the polytetrafluoroethylene sheet to function as the sleeve inlet collar 30 and the sleeve outlet collar 40. Though several embodiments of elastically deformable sleeves have been described herein, it should be understood that numerous variations are possible.

Figure 3:
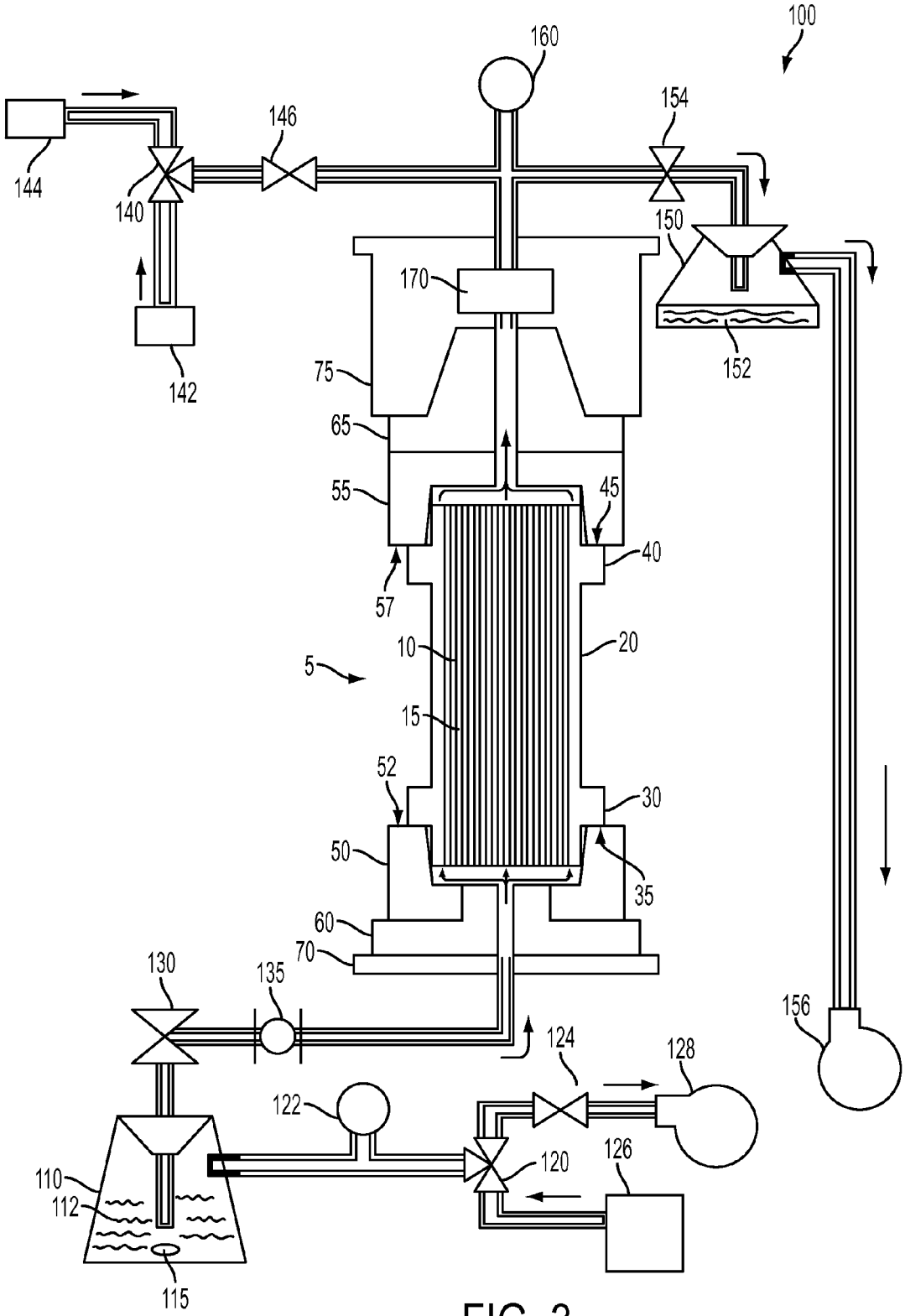
FIG. 3 is a schematic diagram of a coating apparatus according to embodiments described herein, including the monolith substrate and the elastically deformable sleeve.

Referring now to FIG. 3, in addition to the sleeved monolith substrate 5, the coating apparatus 100 also includes a liquid-precursor source 110 in fluidic communication with a general inlet interface 70 that allows passage of a liquid precursor 112 to flow from the liquid-precursor source 110 through the general inlet interface 70 and into the monolith channels 15 of the monolith substrate 10. In some embodiments, the general inlet interface 70 may be any rigid material such as a polymer, a rubber, or a metal. For example, the general inlet interface 70 may be formed from poly(vinyl chloride) or stainless steel.

The liquid precursor source 110 provides a liquid precursor 112 to the monolith channels 15. In some embodiments the liquid precursor may contains materials or nutrients that are necessary to form a coating layer, such as an inorganic membrane precursor layer, for example, on the surfaces of the monolith channels 15. The liquid precursor 112 may be a solution or may be a suspension, slip, or slurry of solid materials in a carrier liquid. The carrier liquid may be either water-based or organic solvent-based. The materials or ingredients of the liquid precursor 112 may include one or more types of solid particles such as, but not limited to, alumina, cordierite, mullite, or other ceramic materials suitable for forming a coating layer or an inorganic membrane precursor layer; metals; dispersion agents; binders; anti-cracking additives; organic templates; pore fillers; or other precursors of inorganic membrane materials.

In an illustrative embodiment, the liquid precursor 112 may be prepared by mixing an inorganic material such as metal hydroxide or ceramic particles with solvent, dispersant, anti-cracking additives, and organic templates. For example, a cordierite slip may be made by mixing fine cordierite powder with water, Tiron® (4,5-Dihydroxy-1,3-benzenedisulfonic acid disodium salt, available from Fluka), PEG solution (polyethylene glycol, MW=20,000, available from Fluka), and DC-B anti-foam emulsion solution (available from Dow-Corning), followed by ball-milling overnight.

In some embodiments, control mechanisms such as a precursor solenoid 130, a manual precursor valve 135, or both, may be disposed along the fluidic pathway between the liquid-precursor source 110 and the general inlet interface 70. Solenoid valves in general may operate in either a normally-open state or a normally-closed state. Normally-open solenoids permit fluidic passage through the solenoid until the solenoid is energized, for example, by an applied voltage, to close the solenoid. In the opposite way, normally-closed solenoids block fluidic passage through the solenoid until the solenoid is energized, for example, by an applied voltage, to open the solenoid. When the applied voltage is removed from either type of energized solenoid, the normally-open solenoid reverts to its open state and the normally-closed solenoid reverts to its closed state. In some embodiments, when present, the precursor solenoid 130 may be configured as a normally-open solenoid.

In the embodiment of FIG. 3, the liquid-precursor source 110 is disposed between an inlet flow selector 120 and the precursor solenoid 130. The inlet flow selector 120 may comprise suitable valve mechanisms to permit selection of flow into the liquid-precursor source 110 from either the inlet vacuum pump 128 or the inlet air purge 126. The inlet vacuum pump 128 may be further regulated, for example, by an inlet vacuum solenoid 124. In some embodiments, the inlet vacuum solenoid 124 is configured as a normally-open solenoid. The inlet air purge 126 may be at atmospheric pressure or, for example, simply open to the environment to allow air in, or processes gases out, as required when the inlet flow selector 120 is oriented to establish fluidic communication between the inlet air purge 126 and the liquid-precursor source 110. In an illustrative embodiment, the liquid precursor 112 in the liquid-precursor source 110 may be degassed by orienting the inlet flow selector 120 toward the inlet vacuum pump 128, with the precursor solenoid 130 or the manual precursor valve 135 closed and with the inlet vacuum solenoid 124 open, and drawing a suitable vacuum with the inlet vacuum pump 128. The strength of the vacuum in the lines connected to the inlet vacuum pump 128 may be assessed, for example, with inlet pressure sensor 122, which may be any suitable type of vacuum gauge such as a manometer or a capacitive sensor.

According to embodiments, the coating apparatus 100 may further include a general outlet interface 75 configured to place the monolith channels 15 of the monolith substrate 10 in fluidic communication with a drawing system. The general outlet interface 75 may be any rigid material such as a polymer, a rubber, or a metal. For example, the general outlet interface 75 may be formed from poly(vinyl chloride) or stainless steel. In the embodiment of FIG. 3, the drawing system includes a push component and a draw component. The term "push" is used in the sense that, generally when the push component is in fluidic communication with the monolith channels 15, any precursor liquid in the monolith channels 15 will be pushed back toward the liquid-precursor source 110, provided that the pressure measured at the outlet pressure sensor 160 is higher than the pressure measured at the inlet pressure sensor 122. Conversely, the term "draw" is used in the sense that, generally when the draw component is in fluidic communication with the monolith channels 15, precursor liquid will be drawn into the monolith channels 15 from the liquid-precursor source 110, provided a pressure measured at the outlet pressure sensor 160 is lower than the pressure measured at the inlet pressure sensor 122. The pressure differentials necessary to establish the desired "push" or "draw" phenomenon in the drawing system can be controlled by adjusting any appropriate valve or solenoid in the coating apparatus 100 or by adjusting the strength of the vacuums pulled by the inlet vacuum pump 128, the outlet vacuum pump 156, or both.

The push component of this embodiment may include an outlet pressurized purge 142, which may introduce a pressurized gas such as nitrogen, and an outlet air purge 144, which may be at atmospheric pressure or, for example, simply open to the environment to allow air in when the coating apparatus 100 is under vacuum. Flow from the push component may be selected by an outlet backflow selector 140, which may be any suitable type of manually or automatically switchable three-way valve. The push component may be actuated by valves such as outlet backflow solenoid 146. In some embodiments, the push component may be actuated by an outlet backflow solenoid 146 that has a normally-open state, such that an electrical signal is required to close the outlet backflow solenoid 146.

The draw component of this embodiment may include an outlet vacuum pump 156 and, optionally an overflow trap 150 for preventing flow of overflow liquid 152 into the outlet vacuum pump 156. The pressure of the drawing system may be monitored by suitable mechanisms such as by outlet pressure sensor 160, which may be any type of vacuum gauge such as a manometer or a capacitive sensor. The draw component may be actuated by valves such as outlet vacuum solenoid 154. In some embodiments, the draw component may be actuated by an outlet vacuum solenoid 154 that has a normally-closed state, such that an electrical signal is required to open the outlet vacuum solenoid 154.

According to embodiments, the coating apparatus 100 may include an inlet substrate receptor 50 positioned between the general inlet interface 70 and the sleeved monolith substrate 5. The inlet substrate receptor 50 has an inlet receptor surface 52. In some embodiments, the inlet substrate receptor 50 may be provided as a sealing cup. In some embodiments, the inlet receptor surface 52 may be a sealing surface. In some embodiments, the inlet substrate receptor 50 may be formed from any material of a suitable durometer that enables a leak-free vacuum seal at operating pressures from about 2 in. Hg (5.08 cm Hg) to about 30 in. Hg (76.2 cm Hg) at the interface of the inlet receptor surface 52 and the sleeve inlet collar surface 35 of the elastically deformable sleeve 20 when the two surfaces are in contact during operation of the coating apparatus 100. In some embodiments, the Shore A durometer of the inlet substrate receptor 50 may be greater than or equal to 25 or greater than or equal to 30. Though the choice of such a material is not limited by anything except for its ability to maintain a vacuum-tight seal, some non-limiting examples of suitable materials for the inlet substrate receptor 50 may include, polymers such as poly(vinyl chloride), rubbers such as silicones, and even metals such as stainless steel. In some embodiments, the inlet substrate receptor 50 may be formed from a material that also is sufficiently soft to allow the inlet substrate receptor 50 to conform to the contours of the sleeve inlet end 22, thereby increasing the likelihood of a vacuum-tight seal. In one illustrative embodiment, the inlet substrate receptor 50 may be formed from poly(vinyl chloride) having a Shore A hardness of about 30.

According to embodiments, the coating apparatus 100 may include an outlet substrate receptor 55 positioned between the general outlet interface 75 and the sleeved monolith substrate 5. The outlet substrate receptor 55 has an outlet receptor surface 57. In some embodiments, the outlet substrate receptor 55 may be provided as a sealing cup. In some embodiments, the inlet receptor surface 57 may be a sealing surface. In some embodiments, the outlet substrate receptor 55 may be formed of any material of a suitable durometer that enables a leak-free vacuum seal at operating pressures of from about 2 in. Hg (5.08 cm Hg) to about 30 in. Hg (76.2 cm Hg) at the interface of the outlet receptor surface 57 and the sleeve outlet collar surface 45 of the elastically deformable sleeve 20 when the two surfaces are in contact during operation of the coating apparatus 100. In some embodiments, the Shore A durometer of the outlet substrate receptor 55 may be greater than or equal to 25 or greater than or equal to 30. Though the choice of such a material is not limited by anything except for its ability to maintain a vacuum-tight seal, some non-limiting examples of suitable materials for the outlet substrate receptor 55 may include, polymers such as poly(vinyl chloride), rubbers such as silicones, and even metals such as stainless steel. In some embodiments, the outlet substrate receptor 55 may be formed from a material that also is sufficiently soft to allow the outlet substrate receptor 55 to conform to the contours of the sleeve outlet end 24, thereby increasing the likelihood of a vacuum-tight seal. In one illustrative embodiment, the outlet substrate receptor 55 may be formed from poly(vinyl chloride) having a Shore A hardness of about 30.

According to some embodiments, one or both of the inlet substrate receptor 50 and the outlet substrate receptor 55 may be molded or formed and be sufficiently pliable so as to accommodate a variety of shapes and sizes of the sleeved monolith substrate 5. According to alternative embodiments, one or both of the inlet substrate receptor 50 and the outlet substrate receptor 55 may either be molded or formed to accommodate only a specific size and shape of sleeved monolith substrate 5. According to further embodiments, one or both of the inlet substrate receptor 50 and the outlet substrate receptor 55 may be removed or replaced without the use of any tools.

In some embodiments, the coating apparatus 100 may further comprise a modular inlet interface 60 configured to interconnect the inlet substrate receptor 50 and the general inlet interface 70. To increase versatility of the coating apparatus 100 for processing of sleeved monolith substrates of various shapes and sizes, the modular inlet interface 60 may be a removable structure, custom-designed to one or more specified shape and size of sleeved monolith substrate 5, that can be replaced as necessary with a modular inlet interface 60 of a different design. In some embodiments, the modular inlet interface 60 may be changed without the use of tools. Though in the embodiment of FIG. 3, the inlet substrate receptor 50 and the modular inlet interface 60 are separate pieces, each individually removable and replaceable, further embodiments are contemplated, in which the inlet substrate receptor 50 and the modular inlet interface 60 may be tooled as a single piece. The modular inlet interface 60 may be any material mechanically suitable for providing an interface between the general inlet interface 70 and the inlet substrate receptor 50. Non-limiting examples include polymers, rubbers, and metals. In illustrative embodiments, the modular inlet interface 60 may be formed from poly(vinyl chloride) or stainless steel.

In some embodiments, the coating apparatus 100 may further comprise a modular outlet interface 65 configured to interconnect the outlet substrate receptor 55 and the general outlet interface 75. To increase versatility of the coating apparatus 100 for processing of sleeved monolith substrates of various shapes and sizes, the modular outlet interface 65 may be a removable structure, custom-designed to one or more specified shape and size of sleeved monolith substrate 5, that can be replaced as necessary with a modular outlet interface 65 of a different design. In some embodiments, the modular outlet interface 65 may be changed without the use of tools. Though in the embodiment of FIG. 3, the outlet substrate receptor 55 and the modular outlet interface 65 are separate pieces, each individually removable and replaceable, further embodiments are contemplated, in which the outlet substrate receptor 55 and the modular outlet interface 65 may be tooled as a single piece. The modular outlet interface 65 may be any material mechanically suitable for providing an interface between the general outlet interface 75 and the outlet substrate receptor 55. Non-limiting examples include polymers, rubbers, and metals. In illustrative embodiments, the modular outlet interface 65 may be formed from poly(vinyl chloride) or stainless steel.

In some embodiments, the coating apparatus 100 may comprise a precursor level sensor 170 such as an ultrasonic sensor, for example, that detects when liquid precursor reaches a certain position in the coating apparatus 100. In the embodiment of FIG. 3, the precursor level sensor 170 is positioned within the general outlet interface 75, such that a signal may be sent from the precursor level sensor 170 when precursor liquid is known to have traveled completely through the monolith channels 15 from the liquid-precursor source 110. Such a signal may be desirable, for example, to determine a time at which a soaking phase of a coating process should begin. It should be understood that any or all of the control components of the coating apparatus 100 shown in FIG. 3, including all valves, solenoids, sensors, vacuum pumps, inlets, and outlets, may be remotely controlled or monitored, such as through electrical connections with an automated control apparatus such as a computer or a control panel. Furthermore, it should be understood also that any such electrical connections may be established by ordinary means such as wires, even though no such wires are shown in FIG. 3.

In some embodiments, during operation of the coating apparatus 100, the sleeved monolith substrate 5 is removably interposed between the inlet substrate receptor 50 and the outlet substrate receptor 55. When the sleeved monolith substrate 5 is positioned in this manner, the inlet substrate receptor 50 accommodates the sleeve inlet end 22 (see FIG. 2), and the sleeve inlet collar surface 35 forms a vacuum-tight seal against the inlet receptor surface 52. Likewise, the outlet substrate receptor 55 accommodates the sleeve outlet end 24 (see FIG. 2), and the outlet receptor surface 57 forms a vacuum-tight seal against the sleeve outlet collar surface 45. As such, the monolith channels 15 of the monolith substrate 10 are placed in fluidic communication with the general inlet interface 70 and the general outlet interface 75 and also potentially with the liquid-precursor source 110 and the drawing system (such as the outlet vacuum pump 156, the outlet pressurized purge 142, or the outlet air purge 144), depending on the positions of any intervening valves, solenoids, or control apparatus.

In some embodiments, and as shown in FIG. 3, the inlet substrate receptor 50 may have a contour that supports or even conforms to the sleeve inlet end 22 (see FIG. 2) while leaving space open between the sleeve inlet end 22 and the inlet substrate receptor 50 for liquid precursor to first flow laterally and then into all of the monolith channels 15 of the monolith substrate 10. Likewise, the outlet substrate receptor 55 may have a contour that supports or even conforms to the sleeve outlet end 24 (see FIG. 2) while leaving space open between the sleeve outlet end 24 and the outlet substrate receptor 55 for liquid precursor to flow first out of monolith channels 15, then laterally, and then toward the precursor level sensor 170.

Optionally, in some embodiments the coating apparatus 100 may include one or more mechanisms (not shown) adapted to adjust the separation distance between the general inlet interface 70 and the general outlet interface 75. The separation distance may be adjusted by moving only the general inlet interface 70, only the general outlet interface 75, or both the general inlet interface 70 and the general outlet interface 75. Such mechanisms may increase the versatility of the coating apparatus 100 by enabling the coating apparatus 100 to accommodate monolith substrates having various lengths. Additionally, the mechanisms may be configured to apply a slight pressure against the monolith substrate in a direction parallel to the monolith channels 15, so as to optimize the vacuum seals between the inlet substrate receptor 50 and the sleeve inlet collar surface 35, and also between the outlet substrate receptor 55 and the sleeve outlet collar surface 45. In illustrative embodiments, such mechanisms may include hydraulic presses or rams, for example.

In some embodiments, and as shown in FIG. 3, the elastically deformable sleeve 20 may be the only barrier separating the monolith substrate 10 from the ambient environment. In such embodiments, an external vacuum chamber requiring support mounts and gasket seals, for example, is unnecessary, because the elastically deformable sleeve 20 provides complete, vacuum-tight isolation of the monolith substrate 10 during a coating process. Additionally, the operation of the drawing system may remove all excess precursor liquid from the monolith channels 15, thereby eliminating any need for further precursor-liquid removal processes such as spin drying. Removal of the excess precursor liquid from the monolith channels 15 also may eliminate the possibility of personnel exposure to the precursor liquid that would be present in an external-chamber apparatus.

Though in the embodiment shown in FIG. 3 the sleeved monolith substrate 5 is shown as oriented vertically and a general flow path from the liquid-precursor source 110 to the precursor level sensor 170 is established generally upwardly, it should be understood that this is meant to be an illustrative configuration only. There is no limitation as to how the sleeved monolith substrate 5 may be oriented, and any practical orientation of the coating apparatus 100, such as horizontal, for example, is contemplated in further embodiments herein.

Figure 4A:
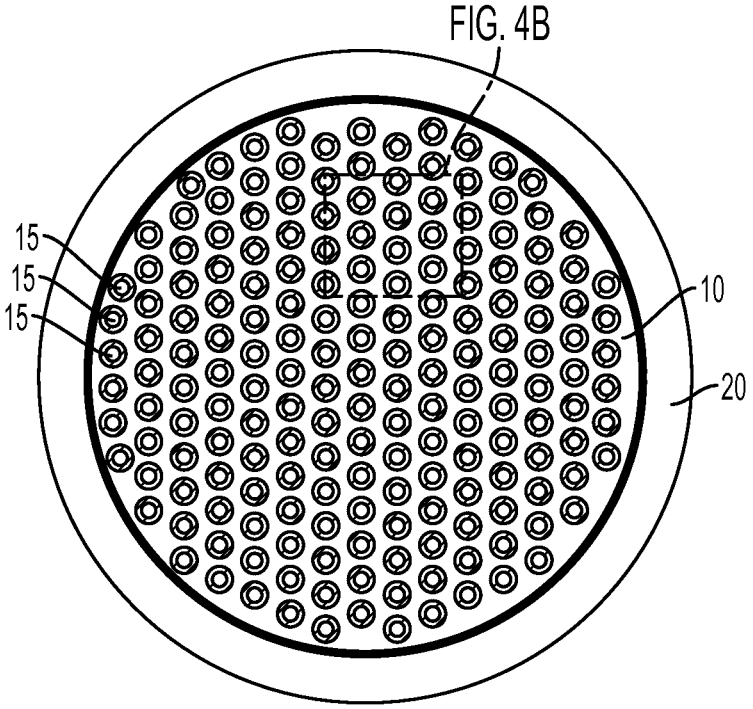
FIG. 4 is a horizontal cross-section of the monolith substrate inside the elastically deformable sleeve shown in FIG. 1, including a coating layer applied using the coating apparatus of FIG. 3.
Figure 4B:
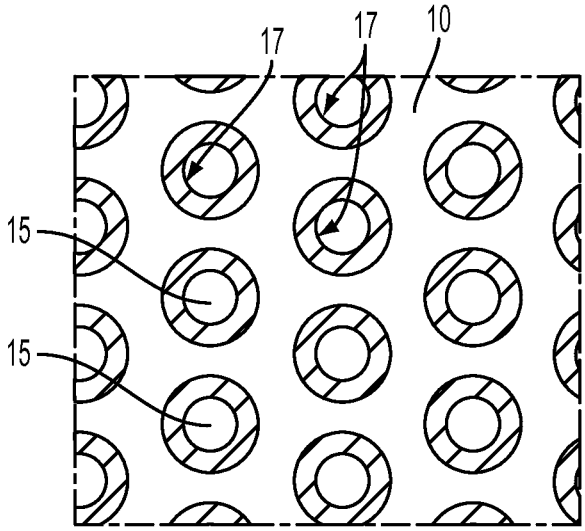

Embodiments of the coating apparatus have been described in detail. Further embodiments directed to methods of forming a coating layer on a monolith substrate with a coating apparatus according to one or more such embodiments will be described. Referring to FIGS. 4A and 4B, which show a transverse cross-section of a monolith substrate 10 laterally surrounded by an elastically deformable sleeve 20 (FIG. 4A) and a magnified view of some monolith channels 15 (FIG. 4B), the methods for forming the coating layer result in the formation of a coating layer 17 on the monolith channel walls of the monolith channels 15. In the embodiments described below of methods of forming a coating layer on a monolith substrate, unless noted otherwise, all references to components of the coating apparatus 100 are made referring to FIG. 3.

In embodiments, methods for forming a coating layer on a monolith substrate 10 are provided, using a coating apparatus 100 comprising: a liquid-precursor source 110 in fluidic communication with a general inlet interface 70; an inlet substrate receptor 50 positioned between the general inlet interface 70 and the sleeved monolith substrate 5, the inlet substrate receptor 50 having an inlet receptor surface 52; a general outlet interface 75 in fluidic communication with a drawing system; and an outlet substrate receptor 55 positioned between the general outlet interface 75 and the sleeved monolith substrate 5, the outlet substrate receptor 55 having an outlet receptor surface 57. In some non-limiting illustrative embodiments, the coating layer may comprise an inorganic membrane or a precursor layer of an inorganic membrane.

In embodiments, the methods for forming a coating layer on a monolith substrate 10 may include providing a sleeved monolith substrate 5 composed of a monolith substrate 10 laterally surrounded by an elastically deformable sleeve 20. The elastically deformable sleeve 20 prevents lateral leakage of a vacuum out of the monolith substrate 10 when a vacuum is applied to opposing ends of the monolith substrate 10 not surrounded by the elastically deformable sleeve 20. The methods may further include positioning the sleeved monolith substrate 5 between the inlet substrate receptor 50 and the outlet substrate receptor 55 so as to establish fluidic communication between the general inlet interface 70 and the general outlet interface 75 through monolith channels 15 of the monolith substrate 10. Then, a first pressure differential may be established between the liquid-precursor source 110 and the drawing system, so that the first pressure differential draws liquid precursor 112 from the liquid-precursor source 110 and into the monolith channels 15. The first pressure differential may be maintained at least until the precursor liquid reaches the general outlet interface 75. The coating process may be concluded by establishing a second pressure differential between the liquid-precursor source 110 and the drawing system, such that the second pressure differential removes excess precursor liquid from the monolith channels.

In embodiments, the methods for forming a coating layer on a monolith substrate 10 may include providing a sleeved monolith substrate 5 comprising a monolith substrate 10 laterally surrounded by an elastically deformable sleeve 20 that prevents lateral leakage of a vacuum out of the monolith substrate 10 when a vacuum is applied to opposing ends of the monolith substrate 10 not surrounded by the elastically deformable sleeve 20. The monolith substrate 10, the elastically deformable sleeve 20, and methods for combining the monolith substrate 10 and the elastically deformable sleeve 20 to form the sleeved monolith substrate 5, have been described in detail above with regard to embodiments of the coating apparatus 100.

In embodiments, the methods for forming a coating layer on a monolith substrate may include positioning the sleeved monolith substrate between the inlet substrate receptor and the outlet substrate receptor so as to establish fluidic communication between the general inlet interface and the general outlet interface through monolith channels of the monolith substrate. In some embodiments, the sleeved monolith substrate may be positioned between the inlet substrate receptor and the outlet substrate receptor by a simple insertion. In other embodiments, the coating apparatus 100 may include mechanical components (not shown) capable of adjusting the separation distance of the general inlet interface 70 and the general outlet interface 75. When such a coating apparatus is used, the general inlet interface 70 and the general outlet interface 75 may be moved apart first to facilitate the initial positioning of the sleeved monolith substrate 5, then moved back together to lock the sleeved monolith substrate 5 in the coating apparatus 100 and to optimize the vacuum-tight seals at the interface of the sleeve inlet collar surface 35 and the inlet receptor surface 52, and also at the interface of the sleeve outlet collar surface 45 and the outlet receptor surface 57.

In embodiments, the methods for forming a coating layer on a monolith substrate may include optionally degassing the liquid precursor 112 before the liquid precursor is drawn into the monolith channels 15 by establishing a first pressure differential between the liquid-precursor source and the drawing system. To degas the liquid precursor 112 using the coating apparatus 100 of FIG. 3, for example, the manual precursor valve 135 may be closed, and a vacuum of from 20 in. Hg (50.8 cm Hg) to 27 in. Hg (68.6 cm Hg) may be produced using the inlet vacuum pump 128. In some embodiments, the degassing may continue as long as necessary for bubbles to cease emanating from within the liquid precursor 112.

In embodiments, the methods for forming a coating layer on a monolith substrate may include establishing a first pressure differential between the liquid-precursor source 110 and the drawing system that draws liquid precursor from the liquid-precursor source and into the monolith channels. The first pressure differential may be established by operating the appropriate valves, solenoids, and vacuum pumps in the coating apparatus 100 to cause the outlet pressure sensor 160 to display a lower pressure than the inlet pressure sensor 122. The optimal magnitude of the first pressure differential depends on the flow characteristics of the liquid precursor. More highly viscous precursor liquids may require a higher first pressure differential than less viscous precursor liquids. In an illustrative embodiment, a first pressure differential of about 10 in. Hg (25.4 cm Hg) may be suitable for drawing an aqueous cordierite slip containing 40 wt. % cordierite particles and 4 wt. % polyethylene-glycol.

In the embodiment described above, the first pressure differential is created using, among other elements, the inlet flow vacuum pump 128 and the outlet pump 156. However, it should be understood that the first pressure differential may be established by other mechanisms. For example, in one embodiment, the inlet flow vacuum pump 128 may be replaced with a mechanical vacuum pump and the outlet pump 156 is not required. In this embodiment, the overflow vessel 150 is open to air. In the embodiment, the mechanical pump is used to establish a pressure differential in the range of 0.1 to 5 atmospheres (10–505 kPa). As the channel size of the substrate is reduced and/or the viscosity of the liquid increases, higher pressure differentials may be needed to coat the substrate.

In embodiments, the methods for forming a coating layer on a monolith substrate may include maintaining the first pressure differential at least until the precursor liquid reaches the ends of the monolith channels 15 nearest the outlet substrate receptor 55. In the embodiment of the coating apparatus 100 of FIG. 3, for example, the precursor level sensor 170 may be used to determine when the precursor liquid has reached the general outlet interface 75. From a signal produced by the precursor level sensor 170 when the precursor liquid has reached the general outlet interface 75, it may be inferred that the precursor liquid has reached beyond the ends of the monolith channels 15 nearest the outlet substrate receptor 55.

In embodiments, the methods for forming a coating layer on a monolith substrate may include optionally equalizing the pressures of the liquid-precursor source 110 and the drawing system and allowing the monolith substrate 10 to soak in the liquid precursor for a predetermined soak time. The pressures of the liquid-precursor source 110 and the drawing system may be equalized, for example, by closing the outlet vacuum solenoid 154, opening the outlet backflow solenoid 146, and allowing a small amount of air (through the outlet air purge 144) or pressurized gas (through the outlet pressurized purge 142) into the coating apparatus 100 until the pressure readings on the outlet pressure sensor 160 and the inlet pressure gauge are equal or until the liquid precursor visibly stops moving. In some embodiments, the predetermined soak time may begin when the signal is produced by the precursor level sensor 170 to indicate that the precursor liquid has reached the general outlet interface 75. In some embodiments, the predetermined soak time may last from 10 seconds to 30 seconds, for several minutes, or even for several hours or several days.

In embodiments, the methods for forming a coating layer on a monolith substrate may include establishing a second pressure differential between the liquid-precursor source and the drawing system that removes excess precursor liquid from the monolith channels. In some embodiments, the second pressure differential may be established using a "pull-only" process. In alternative embodiments, the second pressure differential may be established using a "pull-push" process. These two processes will be described now in greater detail.

In the pull-only process, the second pressure differential may be established by operating the appropriate valves, solenoids, and vacuum pumps in the coating apparatus 100 to cause the outlet pressure sensor 160 to display a higher pressure than the inlet pressure sensor 122. For example, the precursor solenoid 130 may be opened, the outlet backflow solenoid may be opened, the outlet vacuum solenoid 154 may be closed, and inlet vacuum pump 128 may be activated to lower the pressure at the inlet pressure sensor 122 to a predetermined pressure differential with the outlet pressure sensor 160 such as 20 in. Hg (5.08 cm Hg), for example. Thereby, the liquid precursor remaining in the monolith channels 15 may be pulled back toward the liquid-precursor source 110. The pull-only process may continue for a predetermined time such as from 20 seconds to 60 seconds, for example, which typically may be shorter for less-viscous liquid precursors and longer for more-viscous liquid precursors. In some embodiments, the inlet vacuum pump may not need to be activated during the pull-only process. In these embodiments, the liquid precursor material remaining in the monolith channels can be pulled back toward the liquid-precursor source 110 by gravity only. In these embodiments, the inlet flow selector 120 is switched to the inlet air purge 126.

In the pull-push process, as with the pull-only process, the second pressure differential may be established by operating the appropriate valves, solenoids, and vacuum pumps in the coating apparatus 100 to cause the outlet pressure sensor 160 to display a higher pressure than the inlet pressure sensor 122. For example, the precursor solenoid 130 may be opened, the outlet backflow solenoid may be opened, the outlet vacuum solenoid 154 may be closed, and inlet vacuum pump 128 may be activated to lower the pressure at the inlet pressure sensor 122 to a predetermined pressure differential with the outlet pressure sensor 160 such as 20 in. Hg (5.08 cm Hg), for example. Additionally, during the pull-push process the outlet backflow selector 140 may be switched to introduce pressurized gas into the coating apparatus 100 and the monolith channels 15 from the outlet pressurized purge 142. The pressurized gas may be nitrogen or air, for example, at a pressure of from 0.2 psi (1.4 kPa) to 1.2 psi (8.3 kPa), for example. Thereby, any excess liquid precursor is both pulled from the vacuum produced by the inlet vacuum pump 128 and pushed from the pressure introduced through the outlet pressurized purge 142. In some embodiments, the pull-push process may be desirable over the pull-only for removing liquid precursor from the monolith channels, particularly when the monolith channels have very small dimensions or diameters, and also when the liquid precursor is highly viscous.

In some embodiments, if, for example, some liquid precursor becomes clogged within certain monolith channels, the sleeved monolith substrate 5 may be removed from the coating apparatus 100 and reinserted upside-down. Then, the pull-push process may be initiated a second time to dislodge the clogged liquid precursor.

In embodiments, the methods for forming a coating layer on a monolith substrate may include optionally repeating any or all of the foregoing steps at least once to increase the amount of liquid precursor on the monolith channel walls and, thereby, increase the thickness of the coating layer that will be formed when the monolith substrate is fired. In illustrative embodiments, the foregoing steps may be repeated once, twice, three times, or even ten or more times. It may be desirable during each repeated coating cycle to degas the liquid precursor initially, because the removal of liquid precursor from the monolith substrate 10 may cause bubbles to form in the liquid precursor 112 present in the liquid-precursor source 110.

In embodiments, the methods for forming a coating layer on a monolith substrate may include removing the sleeved monolith substrate 5 from the coating apparatus 100. In such embodiments, the sleeved monolith substrate 5 may be simply lifted out of the coating apparatus 100. Alternatively, when the coating apparatus 100 has mechanical components (not shown) capable of adjusting the separation distance of the general inlet interface 70 and the general outlet interface 75, the general inlet interface 70 and the general outlet interface 75 may be moved apart first to facilitate the removal of the sleeved monolith substrate 5 from the coating apparatus 100.

In embodiments, the methods for forming a coating layer on a monolith substrate may include extracting the monolith substrate from the elastically deformable sleeve. In some embodiments, the monolith substrate 10 may be extracted by pushing the monolith substrate 10 out of the elastically deformable sleeve 20, so that the elastically deformable sleeve 20 may be reused in subsequent coating processes with additional monolith substrates. In alternative embodiments, the monolith substrate 10 may be extracted from the elastically deformable sleeve 20 by ripping or tearing the elastically deformable sleeve 20. In such alternative embodiments, the elastically deformable sleeve 20 may not be reusable.

In embodiments, the methods for forming a coating layer on a monolith substrate may include firing the monolith substrate to cause the coating of liquid precursor on the monolith channel walls to cure on, solidify on, or react with the monolith substrate. In illustrative embodiments, the coating layer may be a precursor layer of an inorganic membrane, and the firing causes the inorganic membrane to form on the monolith substrate. The firing of the monolith substrate may be conducted in any suitable vessel, such as an oven, for a predetermined time and at a predetermined temperature depending on the materials from which the monolith substrate and the inorganic membrane are formed. In an illustrative embodiment, if the monolith substrate is a cordierite monolith and the inorganic membrane is a cordierite membrane to be formed from a liquid precursor containing cordierite particles, the monolith substrate may be fired at 900° C. to 1400° C. using a heating rate of from 0.5° C./min to 2° C./min and a dwell time of from 0.5 hours to 5 hours.

In some embodiments, the methods for forming a coating layer on a monolith substrate may include optionally flushing or washing the monolith substrate 10 with a liquid such as deionized water, or with a pressurized gas stream such as nitrogen or air. The flushing or washing may remove any particles or debris from the monolith channels 15 in the monolith substrate 10. When a liquid is used for washing the monolith substrate 10, additionally the monolith substrate 10 may be dried, for example, by placing the monolith substrate in a dry oven at 120° C. for 5 hours to 10 hours or overnight.

In some embodiments, the methods for forming a coating layer on a monolith substrate may include optionally pretreating the monolith substrate before applying the coating layer. The pretreatment process may include plugging pores of the monolith substrate with pore-filling materials, such as those as disclosed in commonly assigned U.S. Pat. No. 7,767,256, incorporated herein by reference in its entirety. The pore-filling materials may include organic materials such as protein particles, protein agglomerates in skim milk, starch particles or synthetic polymer particles, which can be burned off during subsequent membrane firing processes. For example, commercially available skim milk may be used for pretreating the monolith substrate. The skim milk solution can be sucked into pores of the monolith substrate by dip-coating, slip-casting or other methods. Typically, only the inner surfaces of open channels of the monolith substrate contacts the skim milk solution during the pretreatment. After the substrate is contacted with the solution for a brief period, it can be removed from the pre-treatment solution. The pretreated substrate may be dried at room temperature for 24 hours, for example, at an elevated temperature less than 120° C. for 5 hours to 20 hours, for example, or initially at room temperature for 5 hours to 10 hours and subsequently at an elevated temperature less than 120° C. for 5 hours to 10 hours, for example.

Thus, embodiments of coating apparatus and methods for using the coating apparatus have been described. The inclusion of a sleeved monolith substrate made of a monolith substrate laterally surrounded by a vacuum-tight elastically deformable sleeve eliminates the need for costly or bulky vacuum chambers that are difficult to reconfigure for various shapes and sizes of monolith substrates. Modular components such as the modular inlet interface, the inlet substrate receptor, the modular outlet interface, and the outlet substrate receptor further add to the versatility and flexibility of the coating apparatus with regard to scalability and ease of reconfiguration. Methods of coating using the coating apparatus may be conducted using a pull-only process or a pull-push process removes excess liquid precursor in-situ, without a need for time-consuming spin-drying steps. Thus, scalable coating apparatus and methods for coating monolith substrates with coating layers have been provided.

Moreover, it should be understood that the embodiments of the coating apparatus discussed herein may be scaled to accommodate multiple monoliths. For example, multiple general outlet interfaces, inlet substrate receptors, and outlet substrate receptors may be coupled to a common draw system with the appropriate valves and connectors to facilitate the coating of multiple substrates simultaneously.

EXAMPLES

The embodiments described herein will be further clarified by the following examples. Within the following examples, occasional references are made to coating apparatus components using part numbers corresponding to features depicted in FIG. 3 and described in detail above.

Example 1

Coating of a Cordierite Membrane on a Round Cordierite Monolith Substrate

This example describes using the coating apparatus 100, according to embodiments described herein, to coat a cordierite membrane onto a cordierite monolith substrate having a round shape.

A monolith substrate 10 made of cordierite was selected, having an outer diameter of 2.4 inches (6.1 cm) and a length of 4 inches (10.2 cm). The monolith substrate 10 had 1175 monolith channels 15 uniformly distributed over the cross-sectional area of the monolith substrate 10. The average diameter of the monolith channels 15 was 1 mm, and the total surface area was 0.38 $m^2$. The monolith substrate 10 had a median pore size of 4.4 μm and porosity of 46% to 47%, as measured by mercury porosimetry. Before coating, the monolith substrate 10 was flushed with deionized (DI) water and was blown with forced air to remove any loose particles or debris. The washed monolith substrate was dried in an oven at 120° C. for 5 hours to 24 hours.

A water-based solution used as the liquid precursor 112 in this example contained cordierite particles having a median particle size of 1.8 μm, a dispersant, and a polymeric anti-cracking agent. The total solids concentration of the coating solution was 9% by weight. The liquid precursor 112 was placed inside liquid-precursor source 110 and was stirred with a magnetic stirring bar 115. With power set to OFF, the manual precursor valve 135 set to CLOSED, the inlet flow selector 120 set to provide communication with inlet vacuum pump 128, and the outlet backflow selector 140 set to provide communication with outlet air purge 144, the liquid-precursor 112 was degassed at 20-27 in. Hg (50.8-68.6 cm Hg) until all visible bubbles disappeared. The inlet flow selector 120 was switched to Room Pressure (in communication with inlet air purge 126).

The monolith substrate 10 was placed inside an appropriately sized Latex rubber sleeve (elastically deformable sleeve 20) having a length of 4 inches (10.2 cm). Two doubled rubber bands were installed on two ends of the monolith substrate 10 to function as sleeve inlet collar 30 and sleeve outlet collar 40. The monolith substrate 10 was then placed into the inlet substrate receptor 50 that was seated on the modular inlet interface 60. After the outlet substrate receptor 55 and the modular outlet interface 65 were placed on the top of the monolith substrate 10, the monolith substrate 10 was raised up by a linear ram (not shown) and fitted into the general outlet interface 75 to position the coating apparatus 100 as shown in FIG. 3.

Before beginning the coating process, the vacuum regulator of the outlet vacuum pump 156 was adjusted to 10 in. Hg (25.4 cm Hg). The power switch was turned to ON position. All the solenoids activated to opposite their normal condition. That is, the normally-open solenoids (inlet vacuum solenoid 124, precursor solenoid 130, and outlet backflow solenoid 146) were in the CLOSED position, and the normally-closed solenoids (outlet vacuum solenoid 154) were in the OPEN position. After vacuum of 10 in. Hg was verified in the vacuum lines connected to the outlet vacuum pump 156 using outlet pressure sensor 160, the coating apparatus 100 was placed into an initiate coating cycle. The initiate coating cycle caused the inlet vacuum solenoid 124 and the precursor solenoid 130 to deactivate to their normal condition of OPEN.

The liquid precursor 112 was pulled upward and passed through all the monolith channels 15 of the monolith substrate 10 by a pressure differential until it reached the precursor level sensor 170. A signal from the precursor level sensor 170 powered the inlet vacuum solenoid 124 and the precursor solenoid 130 back to their active and CLOSED positions, opposite to their normal conditions. The signal also triggered the start of the soak timer, which was set for about 20 seconds. During this time, the coating apparatus 100 was set to a non-initiate cycle, during which the inlet flow selector 120 was set to establish communication between the liquid-precursor source 110 and the inlet vacuum pump 128.

After the soak timer completed its cycle, all solenoids de-activated to their normal conditions (inlet vacuum solenoid 124, precursor solenoid 130, and outlet backflow solenoid 146 to OPEN, and outlet vacuum solenoid 154 to CLOSED) via a power-off timer. These solenoid positions caused the liquid precursor to be pulled downwardly through the monolith substrate 10 under a vacuum of 20 in. Hg (51 cm Hg) produced by inlet vacuum pump 128, which pulling was assisted when the outlet backflow selector 140 was switched to allow in nitrogen from the outlet pressurized purge 142 at a pressure of 0.2 psi (1.4 kPa). This pressurized nitrogen pushed the liquid precursor from the top of the monolith substrate 10 and back through the monolith substrate 10. This "pull-push" process required about 30 seconds, after which all the liquid precursor had drained out of monolith channels 15. Because the push-pull process introduced bubbles in the liquid-precursor source 110, a degassing of the liquid precursor 112 was required before another monolith substrate could be coated.

The coated monolith substrate was then taken off the coating apparatus 100, and the elastically deformable sleeve 20 was removed from the monolith substrate 10. The coated monolith substrate then was dried at 120° C. for 5 hours and was fired at 1150° C. for 2 hours at a heating rate of 1° C./min.

The membrane coatings were analyzed by microscopy and were found to be approximately 20 μm thick and free of cracks. The median pore size of the membrane coating, as measured by mercury porosimetry, was found to be about 0.3 μm.

Example 2

Cordierite of a Cordierite Membrane on a Pretreated Round Cordierite Monolith Substrate This example describes using the inventive coater to make a cordierite membrane on a round cordierite monolith substrate that was pretreated with pore-filler before coating. The same 2.4"×4" (6.1 cm×10.2 cm) monolith substrate 10 was used as in Example 1.

Before coating, the cleaned monolith substrate was pretreated with certain pore-fillers as described in Corning patent U.S. Pat. No. 7,767,256. In this example, Great Value skim milk from Wal-Mart that contains protein particles was used.

The coating apparatus 100 was used for the pretreatment process. A monolith substrate 10 covered with Latex rubber sleeve (elastically deformable sleeve 20) was coated with skim-milk solution using the same process as for cordierite coating described in Example 1. After excess skim milk was drained out of the monolith channels 15, the monolith substrate 10 was dried at room temperature for 8 hours and 60° C. with the elastically deformable sleeve 20 still on.

The pretreated monolith substrate was coated with the same coating solution and the same coating and draining procedure described above in Example 1. The coated monolith substrate was then dried at 120° C. for 5 hours and was fired at 1150° C. for 2 hours. The resulting membrane coatings were about 15 μm thick, were free of cracks, and had a median pore size of about 0.3 μm.

Example 3

Coating of a Cordierite Membrane on an Oval Cordierite Monolith Substrate

This example describes using the coating apparatus 100 to form a cordierite membrane on a cordierite monolith substrate having an oval shape. The monolith substrate was made of cordierite, and had an oval shape, with a major axis of 3.1 inches (7.9 cm), a minor axis of 1.8 inches (4.6 cm), and a length of 4 inches (2.54 cm). The monolith substrate 10 had 1163 monolith channels 15 uniformly distributed over the cross-sectional area of the monolith substrate 10. The average diameter of the monolith channels 15 was 1 mm, and the total surface area was 0.37 $m^2$. The monolith substrate 10 had a median pore size of 4.4 μm and a porosity of 46% to 47%.

Example 4

Coating of a Cordierite Membrane on a Round Cordierite Monolith Substrate

This example describes flexibility of the coating apparatus 100 to form a cordierite membrane on a shorter round cordierite monolith substrate. The monolith substrate 10 was made of cordierite, having an outer diameter of 1 inch (2.54 cm) and a length of 2 inches (5.08 cm). The monolith substrate 10 had 94 monolith channels 15 uniformly distributed over the cross-sectional area of the monolith substrate 10. The average diameter of the monolith channels 15 was 1.8 mm, larger than the monolith channels of the monolith substrates in the previous examples. The monolith substrate 10 had a median pore size of 4.4 μm and porosity of 46%-47%. Before the coating procedure, the monolith substrate was cleaned and dried in the same way as in Example 1.

The cleaned substrate was coated with the same cordierite coating solution and procedure as described in Example 1. Because of the larger channel size and shorter monolith length compared to the monolith substrates used for previous examples, the draining process was simpler, and only a "pull" strategy was applied. That is, the liquid precursor was pulled down, back through the monolith substrate 10 only by a vacuum of 20 in. Hg (50.8 cm Hg) applied from inlet vacuum pump 128, without assistance of pressure from outlet pressurized purge 142.

The draining process was completed after 20-40 seconds. The coated monolith substrate then was taken off the coating apparatus 100 and the elastically deformable sleeve 20 was removed from the monolith substrate 10. The coated substrate was then dried at 120° C. for 5 h and was fired at 1150° C. for 2 hours.

In a first aspect, the disclosure provides coating apparatus 100 for forming a coating layer 17 on a monolith substrate 10. The coating apparatus 100 comprises a liquid-precursor source 110 in fluidic communication with a general inlet interface 70; a general outlet interface 75 in fluidic communication with a drawing system; an elastically deformable sleeve 20 that laterally surrounds the monolith substrate 10 to form a sleeved monolith substrate 5 and prevents lateral leakage of a vacuum out of the monolith substrate 10 when the vacuum is applied to opposing ends of the monolith substrate 10 not surrounded by the elastically deformable sleeve 20; an inlet substrate receptor 50 positioned between the general inlet interface 70 and the sleeved monolith substrate 5; and an outlet substrate receptor 55 positioned between the general outlet interface 75 and the sleeved monolith substrate 5. In the coating apparatus 100, the sleeved monolith substrate 5 is removably interposed between the inlet substrate receptor 50 and the outlet substrate receptor 55; the inlet substrate receptor 50 accommodates a sleeve inlet end 22 of the elastically deformable sleeve 20; the outlet substrate receptor 55 accommodates a sleeve outlet end 24 of the elastically deformable sleeve 20; and monolith channels 15 of the monolith substrate 10 are in fluidic communication with the general inlet interface 70 and the general outlet interface 75.

In a second aspect, the disclosure provides a coating apparatus 100 of the first aspect, in which the elastically deformable sleeve 20 comprises a sleeve inlet collar 30 having a sleeve inlet collar surface 35; and a sleeve outlet collar 40 having a sleeve outlet collar surface 45; the sleeve inlet collar surface 35 forms a vacuum-tight seal against an inlet receptor surface 52 of the inlet substrate receptor 50; and the sleeve outlet collar surface 45 forms a vacuum-tight seal against an outlet receptor surface 57 of the outlet substrate receptor 55.

In a third aspect, the disclosure provides a coating apparatus 100 of the first or second aspect, in which the elastically deformable sleeve 20 is a material selected from the group consisting of plastics, rubbers, and polymers.

In a fourth aspect, the disclosure provides a coating apparatus 100 of any one of the first through third aspects, in which the elastically deformable sleeve 20 is a material selected from the group consisting of latex and polytetrafluoroethylene.

In a fifth aspect, the disclosure provides a coating apparatus 100 of any one of the first through fourth aspects, in which the elastically deformable sleeve 20 is a material that is sufficiently non-porous so as to prevent lateral vacuum leakage out of the monolith substrate 10 when a vacuum of from about 2 in. Hg (5.08 cm Hg) to about 30 in. Hg (76.2 cm Hg) is applied to the opposing ends of the monolith substrate 10.

In a sixth aspect, the disclosure provides a coating apparatus 100 of any one of the first through fifth aspects, in which the drawing system comprises an outlet vacuum pump 156, an outlet air purge 144, and an outlet pressurized purge 142.

In a seventh aspect, the disclosure provides a coating apparatus 100 of any one of the first through sixth aspects, in which the outlet substrate receptor 55 and the inlet substrate receptor 50 are formed from poly(vinyl chloride).

In an eighth aspect, the disclosure provides a coating apparatus 100 of any one of the first through seventh aspects, in which the coating apparatus 100 further comprises a modular inlet interface 60 that interconnects the inlet substrate receptor 50 and the general inlet interface 70, a modular outlet interface 65 that interconnects the outlet substrate receptor 55 and the general outlet interface 75, or both a modular inlet interface 60 and a modular outlet interface 65.

In a ninth aspect, the disclosure provides a coating apparatus 100 of the eighth aspect, in which at least one of the modular inlet interface 60 and the modular outlet interface 65 is removable from the coating apparatus 100 without use of a tool.

In a tenth aspect, the disclosure provides a coating apparatus 100 of any one of the first through ninth aspects, in which the coating apparatus 100 further comprises a precursor level sensor 170 that detects when liquid precursor 112 has traveled completely through the monolith channels 15.

In an eleventh aspect, the disclosure provides methods for forming a coating layer 17 on a monolith substrate 10 with a coating apparatus 100 according to any one of the first through tenth aspects.

In a twelfth aspect, the disclosure provides methods for forming a coating layer 17 on a monolith substrate 10 with a coating apparatus 100 according to the eleventh aspect, in which the coating apparatus 100 comprises a liquid-precursor source 110 in fluidic communication with a general inlet interface 70; an inlet substrate receptor 50 positioned between the general inlet interface 70 and the sleeved monolith substrate 5; a general outlet interface 75 in fluidic communication with a drawing system; and an outlet substrate receptor 55 positioned between the general outlet interface 75 and the sleeved monolith substrate 5.

In a thirteenth aspect, the disclosure provides a method according to the eleventh aspect or the twelfth aspect, in which the method comprises providing a sleeved monolith substrate 5 comprising a monolith substrate 10 laterally surrounded by an elastically deformable sleeve 20 that prevents lateral leakage of a vacuum out of the monolith substrate 10 when a vacuum is applied to opposing ends of the monolith substrate 10 not surrounded by the elastically deformable sleeve 20.

In a fourteenth aspect, the disclosure provides a method according to the thirteenth aspect, in which the method further comprises positioning the sleeved monolith substrate 5 between the inlet substrate receptor 50 and the outlet substrate receptor 55 so as to establish fluidic communication between the general inlet interface 70 and the general outlet interface 75 through monolith channels 15 of the monolith substrate 10.

In a fifteenth aspect, the disclosure provides a method according to the thirteenth aspect or the fourteenth aspect, in which the method further comprises establishing a first pressure differential between the liquid-precursor source 110 and the drawing system that draws liquid precursor 112 from the liquid-precursor source 110 and into the monolith channels 15.

In a sixteenth aspect, the disclosure provides a method according to any one of the thirteenth through fifteenth aspects, further comprising maintaining the first pressure differential at least until the precursor liquid reaches the ends of the monolith channels 15 nearest the outlet substrate receptor 55.

In a seventeenth aspect, the disclosure provides a method according to any one of the thirteenth through sixteenth aspects, further comprising establishing a second pressure differential between the liquid-precursor source 110 and the drawing system that removes excess precursor liquid from the monolith channels 15.

In an eighteenth aspect, the disclosure provides a method according to any one of the thirteenth through seventeenth aspects, in which the elastically deformable sleeve 20 of the coating apparatus 100 comprises a sleeve inlet collar 30 having a sleeve inlet collar surface 35; and a sleeve outlet collar 40 having a sleeve outlet collar surface 45; the sleeve inlet collar surface 35 forms a vacuum-tight seal against an inlet receptor surface 52 of the inlet substrate receptor 50; and the sleeve outlet collar surface 45 forms a vacuum-tight seal against an outlet receptor surface 57 of the outlet substrate receptor 55.

In a nineteenth aspect, the disclosure provides a method according to any one of the sixteenth through eighteenth aspects, in which establishing the second pressure differential comprises a push-pull process, in which air or a pressurized gas introduced from the drawing system pushes liquid precursor 112 from the monolith channels 15 while an inlet vacuum pump 128 in fluidic communication with the liquid-precursor source 110 pulls the liquid precursor 112 from the monolith channels 15.

In a twentieth aspect, the disclosure provides a method according to the nineteenth aspect, further comprising repeating the push-pull process after first removing the sleeved monolith substrate 5 from the coating apparatus 100 and then reinserting the sleeved monolith substrate 5 into the coating apparatus 100 upside-down.

In a twenty-first aspect, the disclosure provides a method according to any one of the thirteenth through eighteenth aspects, further comprising removing the sleeved monolith substrate 5 from the coating apparatus 100.

In a twenty-second aspect, the disclosure provides a method according to any one of the thirteenth through twenty-first aspects, further comprising extracting the monolith substrate 10 from the elastically deformable sleeve 20.

In a twenty-third aspect, the disclosure provides a method according to any one of the thirteenth through twenty-second aspects, further comprising firing the monolith substrate 10 after extracting the monolith substrate 10 from the elastically deformable sleeve 20.

In a twenty-fourth aspect, the disclosure provides a method according to any one of the thirteenth through twenty-third aspects, in which the coating layer 17 is an inorganic membrane and the liquid precursor 112 is a precursor of the inorganic membrane.

In a twenty-fifth aspect, the disclosure provides a method according to any one of the fifteenth through twenty-fourth aspects, further comprising degassing the liquid precursor 112 before establishing the first pressure differential.

In a twenty-sixth aspect, the disclosure provides a method according to any one of the fifteenth through twenty-fifth aspects, further comprising maintaining the first pressure differential at least until the precursor liquid reaches the ends of the monolith channels 15 nearest the outlet substrate receptor 55.

In a twenty-seventh aspect, the disclosure provides a method according to any one of the fifteenth through twenty-sixth aspects, further comprising equalizing the pressures of the liquid-precursor source 110 and the drawing system for a predetermined soak time to allow the monolith substrate 10 to soak in the liquid precursor 112.

In a twenty-eighth aspect, the disclosure provides a method according to any one of the eleventh through twenty-seventh aspects, in which the monolith substrate 10 is formed from a material selected from the group consisting of glass, ceramics, oxides, non-oxide ceramics, carbon, alloys, metals, polymers, composites of any of these, and mixtures of any of these.

In a twenty-ninth aspect, the disclosure provides a method according to any one of the eleventh through twenty-eighth aspects, in which the monolith substrate 10 is formed from a material selected from the group consisting of alumina, cordierite, and mullite.

In a thirtieth aspect, the disclosure provides a method according to any one of the eleventh through twenty-ninth aspects, in which the coating layer 17 is an inorganic membrane and the liquid precursor 112 is a precursor of the inorganic membrane.

In a thirty-first aspect, the disclosure provides a method according to the thirtieth aspect, in which the liquid precursor 112 is a slurry comprising oxide particles.

In a thirty-second aspect, the disclosure provides a method according to the thirtieth aspect, in which the selected oxide particles are selected from the group consisting of alumina particles, cordierite particles, and mixtures thereof.

It should be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A coating apparatus for forming a coating layer on a monolith substrate, the coating apparatus comprising:

a liquid-precursor source in fluidic communication with a general inlet interface;

a general outlet interface in fluidic communication with a drawing system;

an elastically deformable sleeve that laterally surrounds the monolith substrate to form a sleeved monolith substrate and that prevents lateral leakage of a vacuum out of the monolith substrate when the vacuum is applied to opposing ends of the monolith substrate not surrounded by the elastically deformable sleeve, an inlet substrate receptor positioned between the general inlet interface and the sleeved monolith substrate during operation of the coating apparatus; and an outlet substrate receptor positioned between the general outlet interface and the sleeved monolith substrate during operation of the coating apparatus, wherein:

the elastically deformable sleeve is a sheet of latex or polytetrafluoroethylene wrapped around the monolith substrate horizontally or diagonally to conform to and fit tightly around the outer contours of the monolith substrate, the sheet covering all lateral walls of the monolith substrate;

the elastically deformable sleeve provides complete vacuum-tight isolation of the monolith substrate during operation of the coating apparatus;

the sleeved monolith substrate is removably interposed between the inlet substrate receptor and the outlet substrate receptor;

the inlet substrate receptor accommodates a sleeve inlet end of the elastically deformable sleeve;

the outlet substrate receptor accommodates a sleeve outlet end of the elastically deformable sleeve; and monolith channels of the monolith substrate are in fluidic communication with the general inlet interface and the general outlet interface.

2. The coating apparatus of claim 1, wherein:

the elastically deformable sleeve comprises:

a sleeve inlet collar having a sleeve inlet collar surface; and a sleeve outlet collar having a sleeve outlet collar surface;

the sleeve inlet collar surface forms a vacuum-tight seal against an inlet receptor surface of the inlet substrate receptor; and the sleeve outlet collar surface forms a vacuum-tight seal against an outlet receptor surface of the outlet substrate receptor.

3. The coating apparatus of claim 1, wherein the drawing system comprises an outlet vacuum pump, an outlet air purge, and an outlet pressurized purge.

4. The coating apparatus of claim 1, wherein the outlet substrate receptor and the inlet substrate receptor are formed from poly(vinyl chloride).

5. The coating apparatus of claim 1, further comprising:

a modular inlet interface that interconnects the inlet substrate receptor and the general inlet interface; and a modular outlet interface that interconnects the outlet substrate receptor and the general outlet interface.

6. The coating apparatus of claim 5, wherein at least one of the modular inlet interface and the modular outlet interface is removable from the coating apparatus without use of a tool.

7. The coating apparatus of claim 1, further comprising a precursor level sensor that detects when liquid precursor has traveled completely through the monolith channels.

* * * * *